US008156871B2

(12) United States Patent
Behrmann et al.

(10) Patent No.: US 8,156,871 B2
(45) Date of Patent: Apr. 17, 2012

(54) LINER FOR SHAPED CHARGES

(75) Inventors: Lawrence A. Behrmann, Houston, TX (US); Wenbo Yang, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1010 days.

(21) Appl. No.: 11/858,955

(22) Filed: Sep. 21, 2007

(65) Prior Publication Data

US 2009/0078144 A1 Mar. 26, 2009

(51) Int. Cl.
*F42B 1/02* (2006.01)

(52) U.S. Cl. ..... 102/476; 102/306; 102/307; 89/1.15

(58) Field of Classification Search ..... 102/476, 102/306–310; 89/1.15
See application file for complete search history.

(56) References Cited

U.S. PATENT DOCUMENTS

| | | | | | |
|---|---|---|---|---|---|
| 4,979,443 | A | * | 12/1990 | Rittel et al. | 102/307 |
| 5,033,387 | A | * | 7/1991 | Lips | 102/475 |
| 5,090,324 | A | * | 2/1992 | Bocker et al. | 102/307 |
| 5,259,317 | A | * | 11/1993 | Lips | 102/307 |
| 5,349,908 | A | * | 9/1994 | Walz et al. | 102/307 |
| 5,619,008 | A | * | 4/1997 | Chawla et al. | 102/310 |
| 6,021,714 | A | * | 2/2000 | Grove et al. | 102/307 |
| 6,349,649 | B1 | | 2/2002 | Jacoby | |
| 6,386,109 | B1 | | 5/2002 | Brooks | |
| 6,464,019 | B1 | | 10/2002 | Werner | |
| 6,520,258 | B1 | | 2/2003 | Yang | |
| 6,554,081 | B1 | | 4/2003 | Brooks | |
| 6,619,176 | B2 | * | 9/2003 | Renfro et al. | 86/51 |
| 6,668,726 | B2 | | 12/2003 | Lussier | |
| 6,840,178 | B2 | * | 1/2005 | Collins et al. | 102/476 |
| 6,896,059 | B2 | | 5/2005 | Brooks | |
| 6,899,032 | B2 | * | 5/2005 | Ronn et al. | 102/307 |
| 6,962,634 | B2 | * | 11/2005 | Nielson et al. | 149/19.3 |
| 6,983,698 | B1 | * | 1/2006 | Walters et al. | 102/307 |
| 2003/0131749 | A1 | | 7/2003 | Lussier | |
| 2005/0115448 | A1 | * | 6/2005 | Pratt et al. | 102/476 |
| 2007/0056462 | A1 | | 3/2007 | Bates | |

FOREIGN PATENT DOCUMENTS

| | | |
|---|---|---|
| EP | 1345003 | 5/2004 |
| GB | 2394763 | 5/2004 |
| WO | 2005035939 | 4/2005 |

* cited by examiner

*Primary Examiner* — Michael David
(74) *Attorney, Agent, or Firm* — Chadwick A. Sullivan

(57) ABSTRACT

A liner for a shaped charge is disclosed which comprises a plurality of portions, where at least one portion is composed of powder materials. In one embodiment, the liner comprises two portions that are composed of different powder materials, while alternative embodiments of the liner comprise three portions or four portions. When the shaped charge is used in a perforating gun, reactive powder materials may be added to the plurality of portions of the liner to optimize the penetration or the enhancement of the perforating tunnel.

25 Claims, 4 Drawing Sheets

LINER FOR SHAPED CHARGES

TECHNICAL FIELD

The present invention relates to a liner for a shaped charge where the liner comprises a plurality of portions and where at least one portion comprises a powder material.

BACKGROUND

FIG. 1 shows a typical shaped charge 10 having a metal jacket 11 or a charge case 11. High explosive material 13 is disposed inside the metal jacket 11. A liner 12 retains the explosive material in the jacket 11 during the period prior to detonation. A primer column 15 provides a detonating link between a detonating cord 16 and the explosive 13.

When the shaped charge 10 is detonated a portion of the liner 12 forms a jet portion of the liner. The jet is propelled away from the jacket 11 in a direction 17 toward a target. Another portion of the liner 12 is propelled away from the jacket 11 and forms what is known as a slug or carrot portion of the liner. The slug or carrot portion is not propelled to the same extent as the "jet". When the shaped charge 10 is used in a perforating gun, the target is normally a cased downhole formation. Upon detonation, the jet portion of the liner 12 is propelled through the casing and penetrates the downhole formation to enhance recovery of downhole hydrocarbons. The slug portion, on the other hand, is designed to break up upon contact with the casing.

Only about 25-30 percent of the shaped charge liner mass is converted into the jet. The jet density, velocity profile, jet material, jet straightness, and target properties determine the ability of the jet to penetrate a given target. While the slug portion does not contribute much to the penetration of the shaped charge, the slug should have certain properties that contribute to system performance. For example, the slug should break up and not plug the perforation tunnel in the target.

Liners for shaped charges have been fabricated using pure metals, alloys and/or ceramics. The metals used to form the liners can be powder materials, which may, for example, comprise tungsten, lead or copper. When the latter liners have been used, about 75 percent of the tungsten, i.e. that portion of the tungsten in the slug portion, is not converted into the jet. Since tungsten comprises the bulk of such powder and since tungsten is quite expensive, a substantial amount of money is wasted by fabricating the slug portion of a shaped charge with tungsten.

Liners for shaped charges have been fabricated using different solid materials for the jet and the slug. One such example of a liner utilizing solid copper for the jet and solid zinc for the slug.

SUMMARY

In accordance with the present invention, a liner is provided for a shaped charge which comprises at least two portions where at least one of the portions is composed of powder materials. One of the portions approximate the jet segment and the other portion approximate the segment of the liner.

In one embodiment, a liner according to the present invention comprises three portions, where two of these three portions comprise the slug, and the third portion comprises the jet. In another embodiment, two of the three portions comprise the jet while the third portion comprises the slug.

In a further embodiment, a liner according to the present invention comprises four portions, and each portion of these liners may be composed of the same or different powder materials, in order to optimize the perforation or enhance the perforation tunnel.

In one embodiment, any one portion of a liner in accordance with the present invention may be formed with a powder composed of a single material or any combination of the materials selected from the group consisting of aluminum, copper, lead, tin, bismuth, tungsten, iron, lithium, sulfur, tantalum, zirconium, boron, niobium, titanium, cesium, zinc, magnesium, selenium, tellurium, manganese, nickel, molybdenum, and palladium. The particle sizes of the powder materials for the slug and jet segments of the liner may be selected to achieve a more uniform detonation wave front through the slug and/or jet, while the particle sizes of the powder materials from the jet segment may be selected to achieve a more stable (reduced transverse velocity) jet.

In another embodiment of the present invention, one portion of the liner may be fabricated from a solid material, e.g. copper, zinc, aluminum or lead, while the remaining portions of the liner are fabricated from powder materials.

In accordance with the present invention, a perforating gun is provided comprising a plurality of shaped charges, wherein each shaped charge comprises a jacket, a liner, and an explosive material disposed between the jacket and the liner. The liner for each of the shaped charges comprises at least two portions, as described above.

DETAILED DESCRIPTION

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

Figure 1:
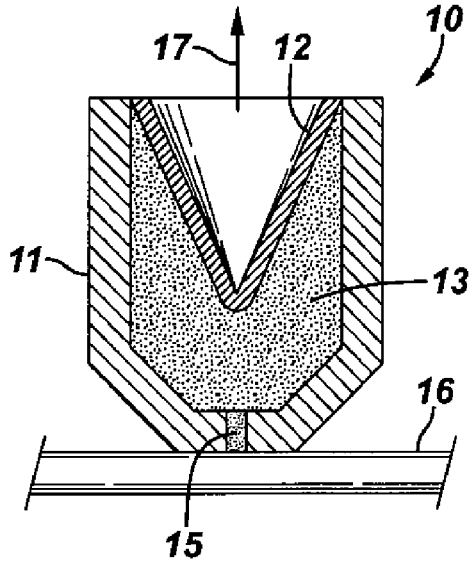
FIG. 1 (Prior Art)
FIG. 1 is an elevation view in partial cross-section of a typical shaped charge according to the prior art.
Figure 2A:
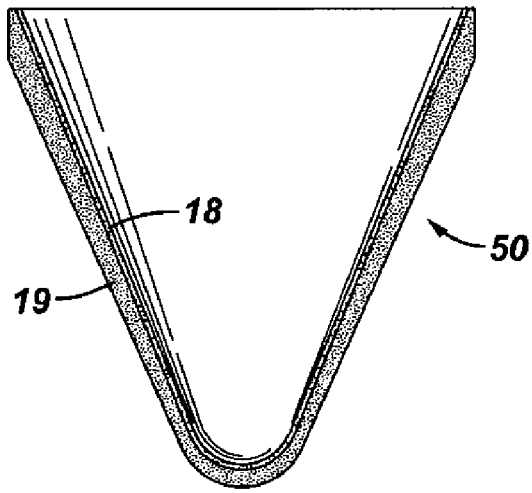
FIG. 2*a* is an elevation drawing in cross-section in an embodiment of a liner in accordance with the present invention which comprises two portions.

With reference first to FIG. 2*a*, one embodiment of a liner 50 in accordance with the present invention is illustrated. Liner 50 comprises a second portion 18 and a first portion 19, where at least one of portion 18 and portion 19 is composed of a powder material and the other of the portion 18 and portion 19 has a different composition than the at least one of the portion 18 and the portion 19. In one embodiment, for example, the second portion 18 and the first portion 19 of the liner 50 are composed of powder materials and each portion may be formed with a powder composed of a single material or any combination of the materials selected from the group consisting of aluminum, copper, lead, tin, bismuth, tungsten, iron, lithium, sulfur, tantalum, zirconium, boron, niobium, titanium, cesium, zinc, magnesium, selenium, tellurium, manganese, nickel, molybdenum, and palladium. Liner 50 may, for example, be fabricated by using a die set, which is an item of apparatus known to those skilled in the art.

Figure 2B:
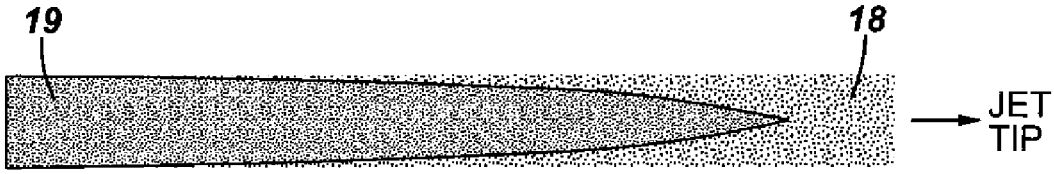
FIG. 2*b* is a pictorial drawing illustrating the jet and slug portions of the two portion liner of FIG. 2*a* upon detonation.

With reference to FIG. 2*b*, a jet portion and a slug portion of liner 50 after detonation of the shaped charge in which liner 50 is installed. The second portion 18 is selected to approximate the jet portion of the liner 50, while the first portion 19 is selected to approximate the slug portion of liner 50.

Figure 2C:
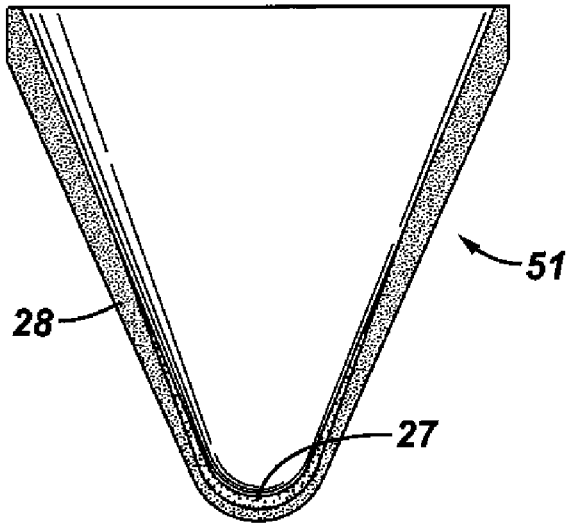
FIG. 2*c* is an elevation drawing in cross-section of another embodiment of a liner in accordance with the present invention which also comprises two portions.

With reference now to FIG. 2*c*, another liner 51 in accordance with an embodiment of the present invention is illustrated. Liner 51 comprises a second portion 27 and a first portion 28. The composition of the second portion 27 is different from the composition of the first portion 28. Each of the second portion 27 and the first portion 28 may be composed of powder materials and be fabricated from a single powder material or any combination of powder material selected from the group consisting of the materials specified in paragraph [0026] above.

Figure 2D:
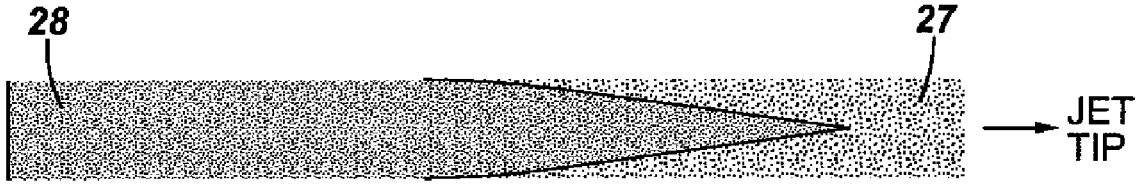
FIG. 2*d* is a pictorial drawing illustrating the jet and slug portions of the liner of FIG. 2*c* upon detonation.

With reference to FIG. 2*d*, the second portion 27 is a jet portion and the first portion 28 is a slug portion of liner 51 after detonation of the shaped charge in which liner 51 is installed. FIG. 2*d* illustrates the portion 27 being fabricated to approximate the jet segment of the liner while the portion 28 is selected to approximate the slug portion of liner 51.

Figure 3A:
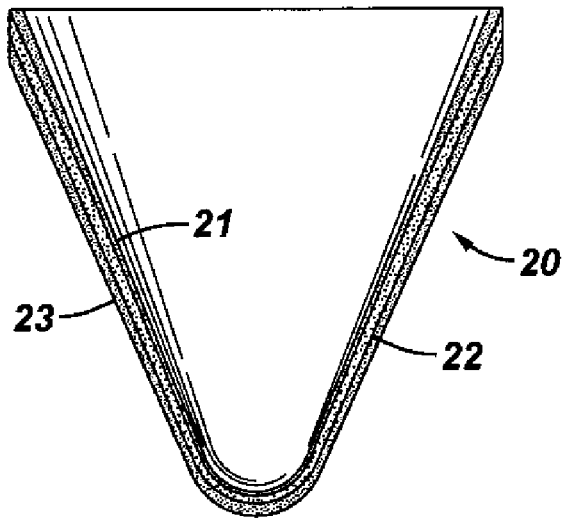
FIG. 3*a* is an elevation drawing in cross-section of an embodiment of a liner in accordance with the present invention which comprises three portions.

FIG. 3*a* illustrates another embodiment of a liner 20 in accordance with the present invention. Liner 20 comprises three portions 21, 22 and 23. Each of the three portions 21, 22 and 23 has a composition that is different from the others. Each portion 21-23 of liner 20 may, for example, be composed of different powder materials. In one embodiment, for example, portion 21-23 of liner 20 may each be formed with a powder composed of a single material or any combination of the materials selected from the group consisting of the materials specified in paragraph [0026]. Liner 20 may be fabricated by using a die set. As illustrated, the different portions 21-23 can be configured in layers so that the portion 23 is an outer layer, portion 21 is an inner layer, and portion 22 is between portions 23 and portion 21. Other configurations are possible too, for example, one portion could be distal to an end of the liner and one portion could be proximal to the end of the liner.

Figure 3B:
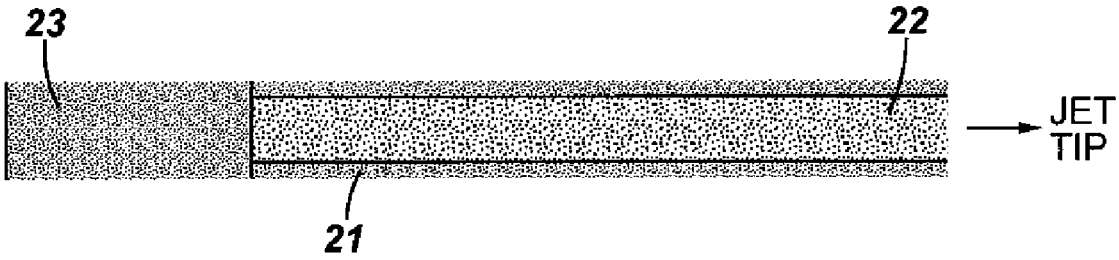
FIG. 3*b* is a pictorial drawing illustrating the jet and slug portions of one embodiment of a three-portion liner upon detonation.

FIG. 3*b* illustrates the jet portion and slug portions of the liner 20 upon detonation of the shaped charge in which liner 20 is installed. In FIG. 3*b*, the jet portion is composed of the portions 21 and 22 of the liner 20, while the slug portion is composed of the portion 23 of the liner.

Figure 3C:
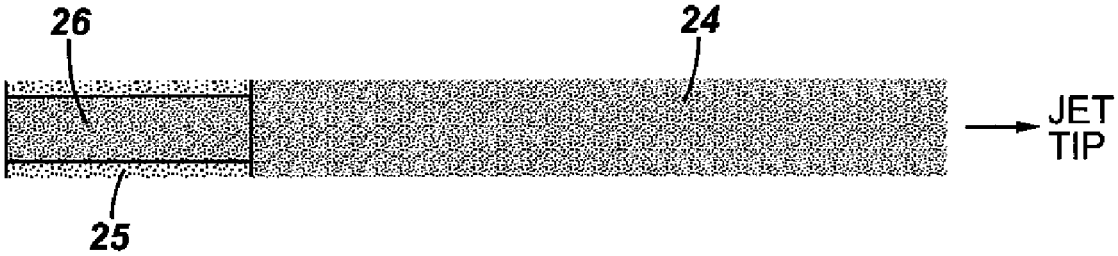
FIG. 3*c* is a pictorial drawing illustrating the jet and slug portions of another embodiment of a three-portion liner upon detonation.

Those skilled in the art who have the benefit of the present disclosure will appreciate that a three layer liner could also produce: (a) a one portion jet segment 24 and a two portion slug segment 25, 26 (FIG. 3*c*); (b) a three portion jet and slug; and (c) a single portion jet tip followed by a single portion jet followed by a single portion slug.

Figure 4A:
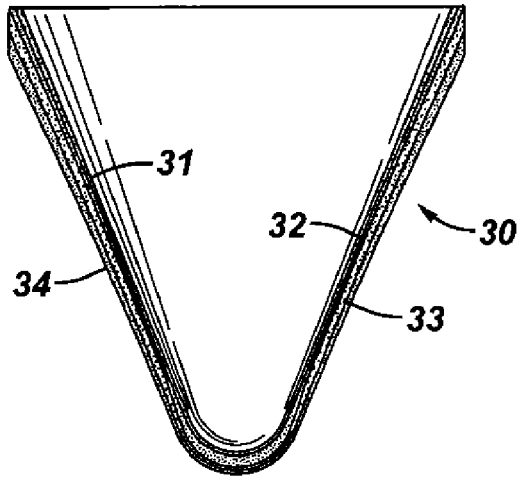
FIG. 4*a* is an elevation drawing in cross-section of a further embodiment of a liner in accordance with the present invention which comprises four portions.
Figure 4B:
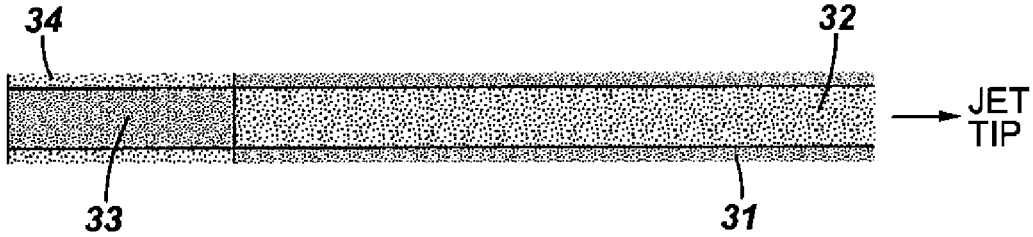
FIG. 4*b* is a pictorial drawing illustrating the jet and slug portions of one embodiment of a four-portion liner upon detonation.

FIG. 4*a* illustrates a liner 30 comprising four different portions 31-34. Each of the four portions has a composition that is different from the others. Each portion of the liner 30 may be fabricated from one or more materials, in order to optimize the penetration or enhance the perforating tunnel. Each portion may, for example, be fabricated from a single powder material or any combination of powder materials selected from the group consisting of the materials specified in paragraph [0026] above. Liner 30 may also be fabricated by using a die set.

Reactive materials may also be utilized in either the jet or slug portion of the liner. The use of reactive materials in a liner is disclosed in U.S. Patent Application Publication No. 2006/0266551, which is incorporated herein by reference.

Figure 5:
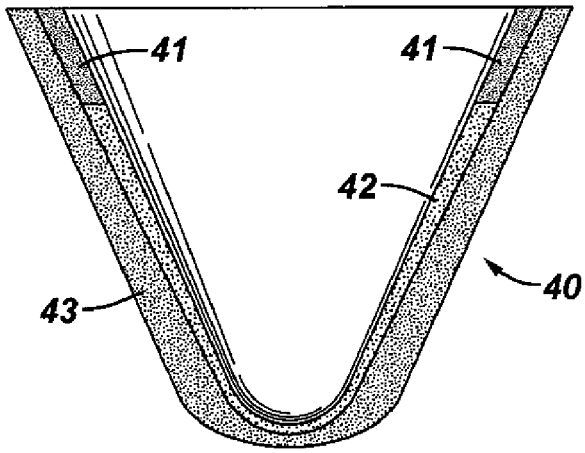
FIG. 5 is an elevation drawing in cross-section of an embodiment of a liner according to the present invention comprising two powder portions and one metal portion.

FIG. 5 illustrates a liner 40 in accordance with the present invention. The liner 40 may comprise three portions 41-43. Each of the portions 41-43 has a composition that is different from the others. The portion 41 is fabricated from a solid material, e.g., copper, zinc, aluminum, tantalum, nickel, or lead, and the other portions 42, 43 of liner 40 are each fabricated from a powder material, e.g., tungsten and/or copper, respectively. Liner 50 (FIG. 2*a*), liner 51 (FIG. 2*c*) and liner 20 (FIG. 3*a*) may also comprise one portion which is fabricated from a solid material as described above.

What is claimed is:

1. A liner for a shaped charge, the shaped charge comprising:

a jacket having a cavity for receiving explosive material therein;

a liner being disposed in the jacket to engage and retain the explosive material in the jacket;

a first layer of the liner having an outer surface directly engaging the explosive material, said first layer having an inner surface;

a second layer of the liner positioned along and abutting the entire inner surface of the first layer, said second layer completely shielded from the explosive material by the first layer;

a first portion of the first layer including—a first powder metal; and a second portion of the second layer including a second powder metal that has a different molecular composition than the first portion.

2. The liner of claim 1, wherein the second portion approximates a jet segment and the first portion approximates a slug segment.

3. The liner of claim 2, wherein the powder material of the first portion and the second portion each comprise a single material or any combination of materials selected from the group consisting of aluminum, copper, lead, tin, bismuth, tungsten, iron, lithium, sulfur, tantalum, zirconium, boron, niobium, titanium, cesium, zinc, magnesium, selenium, tellurium, manganese, nickel, molybdenum, and palladium.

4. The liner of claim 2, wherein the particle size distribution of the powder materials in the first portion and the second portion are each selected to achieve a more uniform detonation wavefront, and wherein the particle size of the powder materials in the second portion is selected to achieve a more stable (reduced transverse velocity) jet.

5. The liner of claim 4, wherein the jet portion of the liner comprises reactive powder materials.

6. The liner of claim 4, wherein the slug portion of the liner comprises reactive powder materials.

7. The liner of claim 1, wherein the first portion of the liner comprises solid material.

8. The liner of claim 1, wherein the second portion of the liner comprises a solid material and wherein the first portion comprises powder materials.

9. The liner of claim 1, wherein the second layer of the liner comprises a third portion that has a composition that is different than the other portions, where each portion comprises powder materials.

10. The liner of claim 9, wherein the powder materials for each of the three portions each have a different composition, each different composition of powder materials comprising a single material or a combination of materials selected from the group consisting of copper, lead, tin, bismuth, tungsten, iron, lithium, sulfur, tantalum, zirconium, boron, niobium, titanium, cesium, zinc, magnesium, selenium, tellurium, manganese, nickel, molybdenum, and palladium.

11. The liner of claim 10, wherein the liner comprises a slug portion and a jet portion, wherein a particle size of the powder materials in the slug portion is selected to achieve a uniform detonation wavefront, and where the particle size of the powder materials in the jet portion is selected to achieve a uniform jet.

12. The liner of claim 10, wherein the third portion of the liner and the second portion of the liner are each designed to comprise the jet segment of the liner, and the first portion is designed to comprise the slug portion.

13. The liner of claim 10, wherein the liner is for use in a shaped charge.

14. The liner of claim 10, wherein the liner further comprises reactive powder materials in the jet portion.

15. The liner of claim 14, wherein the powder materials for each of the three portions comprise a single material or a combination of materials selected from the group consisting of aluminum, copper, lead, tin, bismuth, tungsten, iron, lithium, sulfur, tantalum, zirconium, boron, niobium, titanium, cesium, zinc, magnesium, selenium, tellurium, manganese, nickel, molybdenum, and palladium.

16. The liner of claim 10, wherein the liner further comprises reactive powder materials in the slug portion.

17. The liner of claim 1, wherein the liner comprises a fourth portion that has a composition that is different than the first portion, the second portion and the third portion, where at least one of the portions comprises a solid material and the other three portions comprise powder materials.

18. The liner of claim 1, wherein the liner includes:

an outer surface of the second layer engaged against the first layer;

an inner surface of the second layer;

a third layer of the liner;

a third layer of the liner positioned along the entire inner surface of the second liner; and a third portion of the third layer including a third powder metal that has a different molecular composition than the first portion and the second portion.

19. A liner for a shaped charge, the shaped charge comprising a jacket having a cavity for receiving explosive material and said liner being disposed in the jacket to retain the explosive material in the jacket, the liner comprising a first layer adjacent the explosive material, said first layer having a first portion, a second layer adjacent the first layer portion opposite and completely shielded from the explosive material by the first layer, said second layer having a second portion and a third portion, each of the portions having a different molecular composition than the others, where at least the first portion and the second portion are composed of powder metal materials that have different powder metal molecular compositions than the other.

20. The liner of claim 19, wherein each portion comprises powder materials.

21. The liner of claim 20, wherein the powder materials for each of the three portions comprise a single material or any combination of materials selected from the group consisting of aluminum, copper, lead, tin, bismuth, tungsten, iron, lithium, sulfur, tantalum, zirconium, boron, niobium, titanium, cesium, zinc, magnesium, selenium, tellurium, manganese, nickel, molybdenum, and palladium.

22. The liner of claim 21, wherein the liner comprises a slug portion and a jet portion, wherein the particle size distribution of the powder materials in the slug portion and the jet portion is selected to achieve a uniform detonation wavefront, and wherein the particle size of the powder materials in the jet portion is selected to achieve a stable (reduced transverse velocity) jet.

23. The liner of claim 21, wherein the third portion and the second portion of the liner are each designed to comprise the jet portion of the liner, and the first portion is designed to comprise the slug portion of the liner.

24. The liner of claim 21, wherein the third portion and the second portion of the liner are each designed to comprise the slug portion of the liner, and the first portion is designed to comprise the jet portion of the liner.

25. The liner of claim 21, wherein the liner is for use in a shaped charge.

* * * * *